US008919916B2

(12) United States Patent
Usuda et al.

(10) Patent No.: US 8,919,916 B2
(45) Date of Patent: Dec. 30, 2014

(54) PRINTING SYSTEM, PRINTING METHOD AND PRINTING MEDIUM

(71) Applicant: Seiko Epson Corporation, Tokyo (JP)

(72) Inventors: Hidenori Usuda, Matsumoto (JP); Takayoshi Kagata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/771,425

(22) Filed: Feb. 20, 2013

(65) Prior Publication Data

US 2013/0260107 A1 Oct. 3, 2013

(30) Foreign Application Priority Data

Apr. 2, 2012 (JP) ..... 2012-083631

(51) Int. Cl.

| | |
|---|---|
| ***B41J 2/01*** | (2006.01) |
| ***B41M 5/50*** | (2006.01) |
| ***B41M 3/00*** | (2006.01) |
| ***B41J 3/407*** | (2006.01) |
| ***B41J 11/00*** | (2006.01) |

(52) U.S. Cl.

CPC ... *B41M 5/50* (2013.01); *B41J 2/01* (2013.01); *B41M 3/008* (2013.01); *B41J 3/407* (2013.01); *B41J 11/0015* (2013.01)

USPC ..... 347/20; 347/9; 347/105; 347/101

(58) Field of Classification Search

CPC ..... B41J 2/01; B41J 2/211; B41J 2/1433; B41J 2/17; B41J 2/17593; B41J 2/2107; B41J 2/1755; B41J 2/2114; B41J 11/0015; B41J 2/2056; B41J 2/21; C09D 11/36; C09D 11/40; C09D 11/30; C09D 11/38; C09D 11/322; C09D 11/328; C09D 11/101

USPC ..... 347/100, 95, 96, 101, 20, 21, 9, 105; 106/31.6, 31.13, 31.27; 523/160, 161

See application file for complete search history.

(56) References Cited

U.S. PATENT DOCUMENTS

| | | | |
|---|---|---|---|
| 6,877,850 | B2 | 4/2005 | Ishimoto et al. |
| 7,275,804 | B2 | 10/2007 | Matsushima |

(Continued)

FOREIGN PATENT DOCUMENTS

| | | | |
|---|---|---|---|
| JP | 2005-153314 | A | 6/2005 |
| JP | 2005-254806 | A | 9/2005 |

(Continued)

*Primary Examiner* — Manish S Shah

(74) *Attorney, Agent, or Firm* — Maschoff Brennan

(57) ABSTRACT

A printer includes a printing unit that performs printing by causing at least one of respective colors of ink, clear ink and white ink to be ejected onto a transparent medium, and a controller that controls the printing unit, in which the controller performs control so as to form a design image by causing respective colors of ink to be ejected onto a transparent medium, and performs control so as to form a clear layer by causing clear ink to be ejected in a state overlapped on the design image, and performs controls so as to form a base layer by causing white ink to be ejected overlapped on the clear layer.

6 Claims, 5 Drawing Sheets

(56) References Cited

U.S. PATENT DOCUMENTS

| | | | | |
|---|---|---|---|---|
| 2005/0284314 | A1* | 12/2005 | Coulter et al. | 101/129 |
| 2009/0244116 | A1* | 10/2009 | Ohnishi | 347/6 |
| 2010/0194838 | A1* | 8/2010 | Mitsuzawa | 347/102 |
| 2011/0032299 | A1 | 2/2011 | Mimura | |
| 2011/0096131 | A1* | 4/2011 | Onishi | 347/102 |
| 2011/0157272 | A1* | 6/2011 | Ikehata et al. | 347/16 |

FOREIGN PATENT DOCUMENTS

| | | | |
|---|---|---|---|
| JP | 2006-272934 | A | 10/2006 |
| JP | 2007-030384 | A | 2/2007 |
| JP | 2007-203260 | A | 8/2007 |
| JP | 2007-276482 | A | 10/2007 |
| JP | 2008-149514 | A | 7/2008 |
| JP | 2011-037015 | A | 2/2011 |

* cited by examiner

PRINTING SYSTEM, PRINTING METHOD AND PRINTING MEDIUM

This application claims priority to Japanese Patent Application No. 2012-083631 filed on Apr. 2, 2012. The entire disclosure of Japanese Patent Application No. 2012-083631 is hereby incorporated herein by reference.

BACKGROUND

1. Technical Field

The present invention relates to a printing system, printing method and printing medium.

2. Related Art

Technical content exists in which the surfaces of various types of target object undergo clear coating. As such types of content, there are the disclosures of JP-A-2007-203260 and JP-A-2007-30384. In JP-A-2007-203260, a surface decoration method is disclosed in which after a pre-paint surface preparation, such as a chemical conversion treatment, is performed on an aluminum basic metal member, color and clear coating materials are coated, and a metallic feel having a soft gloss occurs by the colored component of the color and clear coating material layer absorbing diffuse reflection light. In addition, in JP-A-2007-30384, technical content is disclosed in which a double-layered clear coating with a lower layer and an upper layer is provided on a stainless steel plate, and an interference pattern is suppressed by lowering the refractive index of the upper layer further than that of the lower layer from among the two clear coating layers.

Incidentally, in a case in which a printing image is formed on a transparent medium using an ink jet method, there are cases where a base layer is formed by ejecting white ink after a design image is formed by ejecting respective colors of ink on the transparent medium. In such cases, in the parts of the transparent medium in which the design image is not formed, the base layer is in a state of contacting the transparent medium. However, in the white ink, the white has a characteristic which causes light to be scattered. Therefore, a state occurs in which, on the one hand, the glossy feeling of the design image is high, while the glossy feeling of the base layer does not become very high. In other words, on the side of the transparent medium on which the printing image is formed, the glossy feeling becomes uneven due to the formation of parts with a high glossy feeling through forming of a design image and parts with a low glossy feeling through forming of a base layer directly on the transparent medium.

SUMMARY

An advantage of some aspects of the invention is to provide a printing system, printing method and printing medium capable of evening the glossy feeling on the side of a transparent medium on which the printing image is formed.

In order to solve the above problem, the printing system of an aspect of the invention is a printing system that forms a printing image on a transparent medium, and is equipped with a printing unit that performs printing by causing at least one of respective colors of ink, a clear ink, and a white ink to be ejected onto a transparent medium, and a controller that controls the printing unit, and which forms a printing image which is configured from a design image, a clear layer, and a base layer by the controller performing control so as to form a design image on the transparent medium by causing ink of each color to be ejected from the printing unit, and thereafter performing control so as to form a clear layer by clear ink to be ejected from the printing unit in a state of being overlapped on the design image, and further thereafter, performing control so as to form a base layer by causing white ink to be ejected from the printing unit in a state overlapping the clear layer.

In the case of such a configuration, in a printing image which is formed on a transparent medium, the design image is in a state of being overlapped by the clear layer without the base layer being arranged to be directly overlapped on the design image. Therefore, the clear ink is in a state approaching the image part of the design image and the gap part between image parts, and the clear layer formed by hardening of the clear ink is in a state contacting the transparent medium. Therefore, in the base layer side of the transparent medium, the glossy feeling between the design image and the clear layer becoming uneven is prevented, and it is possible to even the glossy feeling.

According to another aspect of the invention, along with the design image being configured by a plurality of image parts formed through attaching respective colors of ink to the transparent medium, it is preferable that the controller control the printing unit such that thick portions are formed, which have a thicker base layer along the direction away from the transparent medium than the other parts in parts where image parts are present.

In the case of such a configuration, in parts where the image parts of the design image are present, thick portions are formed, which have the thickness of the base layer thicker than other parts. Therefore, the design image becomes vividly visually recognizable. In other words, in a case where the thickness of the base layer is thin, as for light which reaches the base layer by transmitting the transparent medium, because light transmitting the base layer becomes more plentiful than other light, in this case, the amount of light that shines from the side separated from the transparent medium (rear side) among the image parts decreases. Conversely to this, in the thick portions of the base layer, because light which transmits the thick portions decreases, the amount of light shining from the rear side of the image parts increases. Therefore, in the thick portions, compared to a case in which the thickness of the base layer is thin, it becomes possible to increase the amount of light shining from the rear side of the image parts, and thereby the image parts of the design image become more vividly visually recognizable.

Furthermore, in another aspect of the invention, in the invention described above, it is preferable that the controller control the printing unit such that thick portions are formed in all the portions opposing the image parts.

In a case of such a configuration, because the thick portion is formed in all the portions opposing the image parts, it is possible to vividly visually recognize the image parts overall.

In addition, according to another aspect of the invention it is preferable that the controller control the printing unit such that the thick portions are formed in an annular shape on the side opposing the contour of the image parts.

In the case of such a configuration, in the design image, it is possible to vividly visually recognize parts opposing the contours of the image parts.

Furthermore, according to another aspect of the invention, it is preferable that the controller control the printing unit so as to provide the thickness of the clear layer along a direction away from the transparent medium in parts in which the image parts are present to be smaller than the thickness after subtracting the thickness of the image parts from the thickness of the clear layer in parts in which the image parts are not present.

In a case of such a configuration, it is possible to make the thickness of the clear layer thin in parts in which the thick portion of the base layer is present.

In addition, according to another aspect of the invention, it is preferable that, in the thick portions, along with the opposing parts opposing the image parts, an extension portion be provided in which the thickness becomes thinner as it separates from the opposing portion along with extending from the opposing portion, and an inclined portion be provided in the side contacting the clear layer of the extension portion and the inclined portion be inclined with respect to a contact face of the transparent medium that contacts the clear layer.

In the case of such a configuration, in the thick portion, an extension portion is provided that extends from the opposing portion which opposes the image part and in the extension portion, an inclined portion is provided. Therefore, in the inclined portion, it is possible to cause light progressing through the clear layer to be largely reflected by being directed toward the front surface side of the transparent medium. Further, through the reflection of the light, the contour of the image part is in a state of being more clearly visually recognized (becomes a so-called sharp edge).

Furthermore, the printing method according to another aspect of the invention is a printing method forming a printing image on a transparent medium, includes controlling the printing unit which performs printing on the transparent medium, printing by a printing unit at least one of respective colors of ink, clear ink and white ink to be ejected onto the transparent medium, in which, forming the printing image configured from a design image, a clear layer and a base layer by performing control so as to form the design image on the transparent medium by causing respective colors of ink to be ejected from the printing unit, and thereafter controlling so as to form a clear layer by causing clear ink to be ejected from the printing unit in a state overlapping the design image, and further thereafter controlling so as to form a base layer by causing white ink to be ejected from the printing unit in a state overlapping the clear layer.

In the case of such a configuration, in the controlling, a printing image is formed on the transparent medium in a state in which the clear layer is overlapped on the design image, without the base layer being arranged to be directly overlapped on the design image. Therefore, in the formed printing medium, the clear ink is in a state approaching the image part of the design image and the gap part between image parts, and the clear layer formed by hardening of the clear ink is in a state contacting the transparent medium. Therefore, in the base layer side of the transparent medium, the glossy feeling between the design image and the clear layer becoming uneven is prevented, and it is possible to even the glossy feeling.

Furthermore, the transparent medium according to another aspect of the invention is printed on using the above-described printing method.

In the case of such a configuration, in a printing image which is formed on a transparent medium, the design image is in a state of being overlapped by the clear layer without the base layer being arranged to be directly overlapped on the design image. Therefore, the clear ink is in a state approaching the image parts of the design image and the gap part between image parts, and the clear layer formed by hardening of the clear ink is in a state contacting the transparent medium. Therefore, in the base layer side of the transparent medium, the glossy feeling between the design image and the clear layer becoming uneven is prevented, and it is possible to even the glossy feeling.

BRIEF DESCRIPTION OF THE DRAWINGS

The invention will be described with reference to the accompanying drawings, wherein like numbers reference like elements.

DESCRIPTION OF EXEMPLARY EMBODIMENTS

Below, a printing system 20 and printing method according to embodiments of the invention will be described with reference to the drawings.

1. Overview

According to an aspect of the invention, in a case where a printing image P is formed on a transparent printing target (hereinafter, referred to as transparent medium 10) using reverse printing, a clear layer P2 is formed by ejecting clear ink after a design image P1 which is recognized as a design by a viewer is formed. Additionally, after the clear layer P2 is formed, white ink is further ejected forming a base layer P3.

Figure 1:
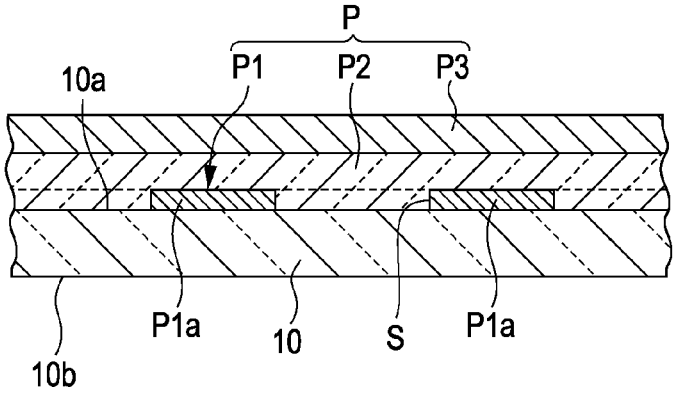
FIG. 1 is a lateral surface cross-sectional view showing a printing image and a transparent medium according to an embodiment of the invention.

Herein, reverse printing, as shown in FIG. 1, indicates a state in which the transparent medium 10 is positioned closer to the viewer side than the printing image P, and in a case where the viewer visually recognized the printing image P, the printing image P is in a state of being visually recognized through the transparent medium 10. In addition, in the description below, of the sides of the transparent medium 10, the side on which the printing image P is formed is the rear side, and the opposite side thereof on which the viewer is positioned is the front side. In addition, the surface of the rear side of the transparent medium 10 is a rear surface 10*a*, and the surface of the front side of the transparent medium 10 is a front surface 10*b*. In addition, the transparent medium 10 on which a printing image P is formed corresponds to a printing medium of the claims. In addition, the printing image P herein indicates an image formed by landing ink droplets through causing a printing head 44 described later to be driven; however, in the printing image P, a design image P1 which is visually recognized as a design by the viewer, a clear layer P2 formed by ejection of clear ink and printing parts (base layer P3) for a base layer of the design image P1, along with being formed by ejection of white ink, are present.

In aspect of the present embodiment, as shown in FIG. 1, after the design image P1 is formed on the transparent medium 10, clear ink is in a state approaching the image parts P1*a* which configure the design image P1 and the gap part S between the image parts P1*a*, and the clear layer P2 formed by hardening of the clear ink is in a state contacting the rear surface 10*a* of the transparent medium 10. Further, after formation of the clear layer P2, the base layer P3 is formed by ejection of white ink. Therefore, in the rear surface 10*a* side of the transparent medium 10, it is possible to even the glossing feeling between the design image P1 (image parts P1*a*) and the clear layer P2.

Figure 2:
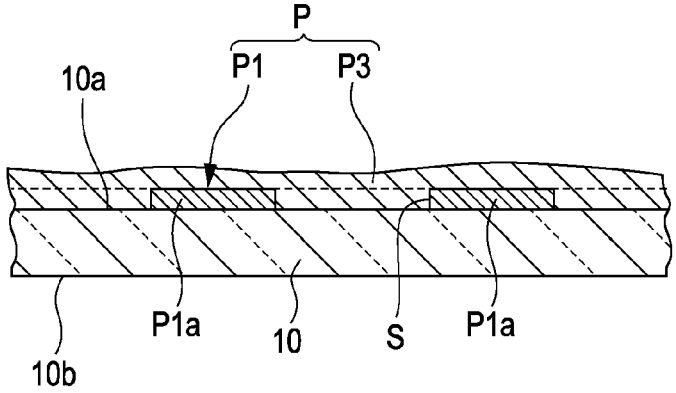
FIG. 2 is lateral cross-sectional view showing a printing image and a transparent medium of the related art.

Here, a configuration of the related art is shown in FIG. 2. In the configuration of the related art, in a case where the printing image P is formed on the transparent medium 10, after the design image P1 is formed on the transparent medium 10, the base layer P3 is formed through ejection of white ink. Therefore, the base layer P3 approaches the image parts P1*a* of the design image P1 and the gap part S between the image parts P1*a*, and the base layer P3 is in a state contacting the transparent medium 10. Here, because the white ink includes white pigment which causes light to be scattered, the white ink does not have a strong glossy feeling. Therefore, the base layer P3 is formed through the ejection of white ink in a state contacting the rear surface 10*a* of the transparent medium 10, and the glossy feeling between the image parts P1*a* of the design image P1 and the parts of the base layer P3 contacting the rear surface 10*a* of the transparent medium 10 becomes uneven. Therefore, in the configuration shown in FIG. 2, the visibility of the printing image P becomes worse.

On the other hand, in the embodiment of the invention, as described above, in the image parts P1*a* of the design image P1 and the gap between the image parts P1*a*, by forming the clear layer P2 in a state contacting the rear surface 10*a* of the transparent medium 10, on the rear surface 10*a* side of the transparent medium 10, it is possible to even the glossy feeling between the design image P1 (image parts P1*a*) and the clear layer P2.

However, in the printing image P in the embodiment of the invention, the function due to providing the clear layer P2 is not only to even the glossy feeling, but also provides the functions below. In other words, because the clear layer P2 is present on a side further separated from the transparent medium 10 (the rear side of image parts P1*a*) than image parts P1*a*, the design image P1 is vividly visually recognizable due to the presence of the clear layer P2 in the parts. In other words, in a case where the clear layer P2 is present on the rear side of the image parts P1*a*, it becomes possible to curve light in the rear side of the image parts P1*a*. Therefore, the curved light is caused to be reflected (scattered) by the base layer P3, and the image parts P1*a* of the design image P1 are caused to shine from the rear surface 10*a* side by the light which is caused to be reflected (scattered). Thereby, in a case where the clear layer P2 is present on the rear side of the image parts P1*a*, the design image P1 is vividly visually recognized compared to a case where the clear layer P2 is not present on the rear side of the image parts P1*a*.

Other Examples 1

Figure 3:
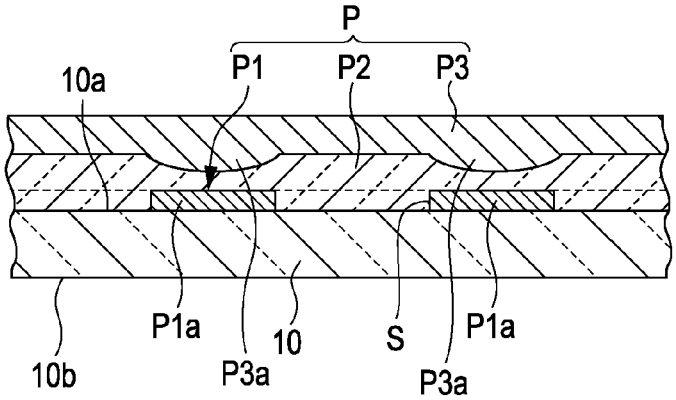
FIG. 3 is a lateral cross-sectional view showing a printing image in which a thick portion is provided in the base layer and a transparent medium.

FIG. 3 is a partial cross-sectional view showing a state in which the thickness of the base layer P3 corresponding to the image parts P1*a* is provided with thick portions P3*a* thicker than the thickness in parts where the image parts P1*a* are not present in the base layer P3. Moreover, in FIG. 3, a state is shown of a case where the viewer visually recognized the printing image P using front light. In other words, in FIG. 3, in rear printing, a state is shown of a case where the viewer and the bright side (for example, the side on which the light source of the front light is positioned) are on the same side of the transparent medium 10.

As shown in FIG. 3, in the parts where image parts P1*a* are present, by providing thick portions P3*a* in which the thickness of the base layer P3 is thicker than the thickness of other parts, the thickness of the clear layer P2 becomes relatively smaller than the other parts. Moreover, conversely to a case in which the thickness of the clear layer P2 is thin, in a case where the thickness of the clear layer P2 becomes relatively thick, an operation and effect are obtained in which the design image P1 appears more solid.

Figure 4A:
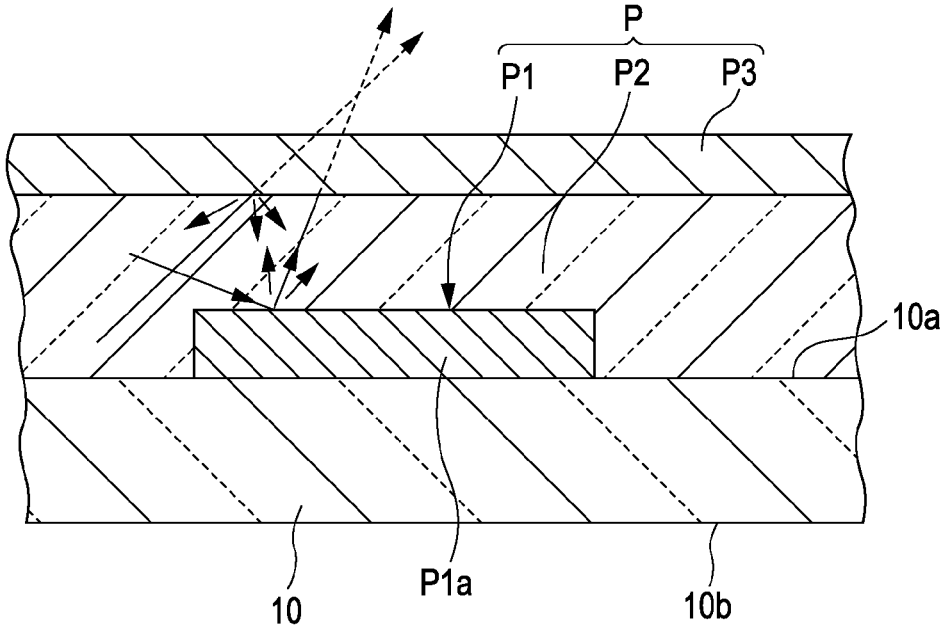
FIGS. 4A and 4B are lateral cross-sectional views showing a condition of the progress of light in a case in which the base layer is thick or thin.

In addition, in the locations in which the image parts P1*a* of the design image P1 are present, thick portions P3*a* are provided in the base layer P3, and in a case where the thickness of the clear layer P2 is made relatively thinner than the other portions, the design image P1 is in a state of being more vividly visually recognized. This is based on the following. In other words, as shown in FIG. 4A, in a configuration in which the thick portions P3*a* are not provided on the base layer P3, when light progressing through the clear layer P2 between the image parts P1*a* and the base layer P3 reaches the base layer P3 or the image parts P1*a*, light which passes through the base layer P3 as shown by the broken lines in FIG. 4A increases. Therefore, in the case of FIG. 4A, the amount of light which shines from the rear side of image parts P1*a* becomes smaller.

Figure 4B:
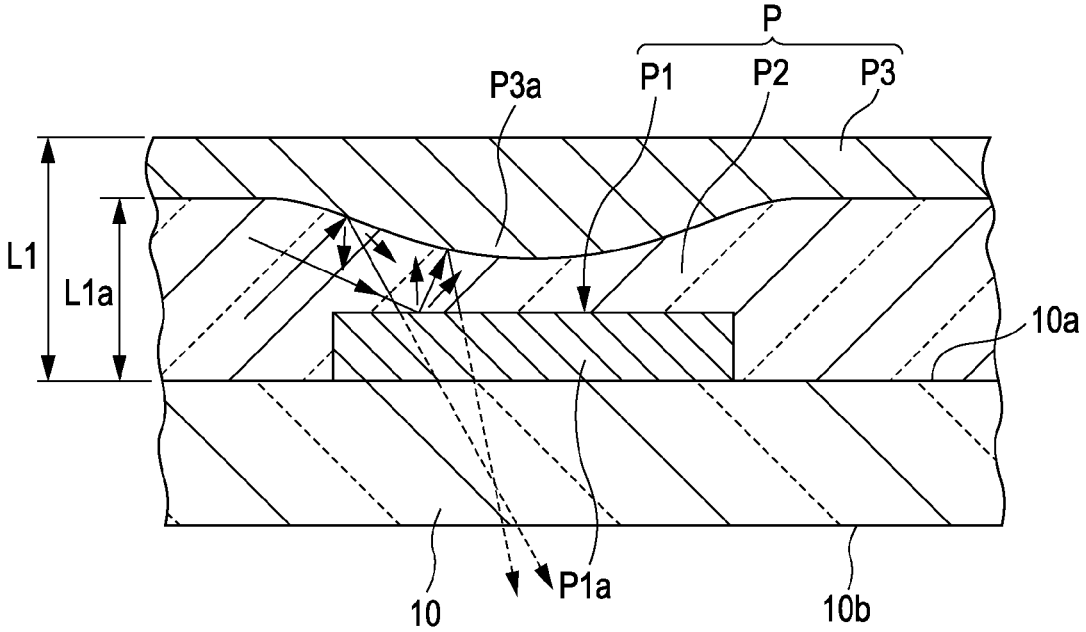

Conversely to this, in a case in which the thick portions 3*a* are provided on the base layer P3 as shown in FIG. 4B, the light passing through the thick portions P3*a* decreases. Therefore, in the case of FIG. 4B, the amount of light shining from the rear side of the image parts P1*a* increases. In so doing, in a case in which the thick portions P3*a* are provided on the rear side of the image parts P1*a*, it becomes possible to increase the amount of light shining from the rear side of the image parts P1*a* compared to a case in which the thickness of the base layer P3 is thin (a case in which the thick portions P3*a* are not provided), and thereby the image parts P1*a* of the design image P1 are more vividly visually recognized.

Another Example 2

Figure 5:
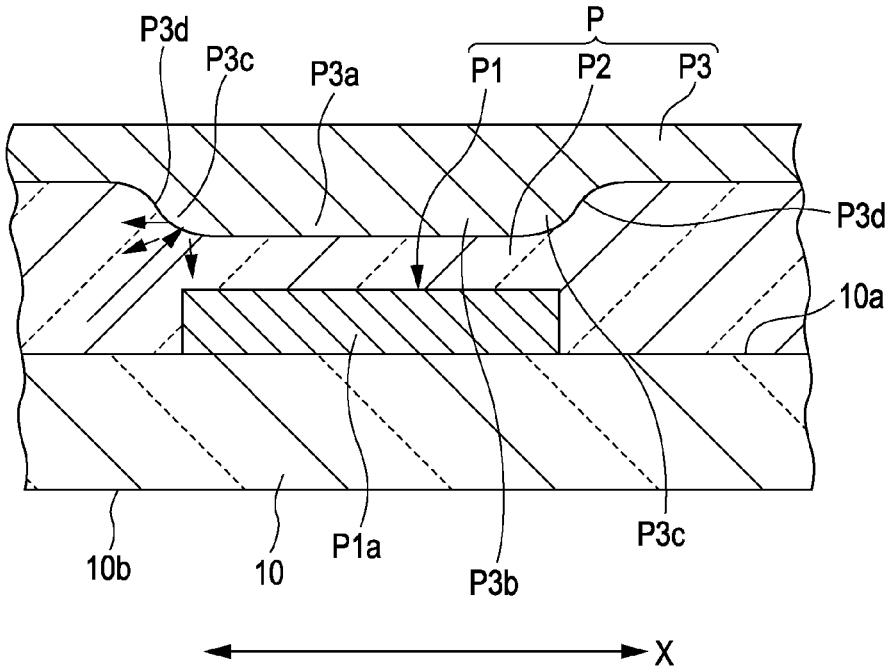
FIG. 5 is a lateral cross-sectional view showing a condition in which an extension portion is present in the base layer.

In addition, in a case in which thick portions P3*a* are provided to have the thicker base layer P3 of the rear side of the image parts P1*a* than the other parts, the configuration may be as shown in FIG. 5 for example. In FIG. 5, the thick portions P3*a* are provided greater than the image parts P1*a* in the X direction in FIG. 5 (direction along the printing image P and the transparent medium 10). In other words, in the thick portions P3*a*, opposing portions P3*b* opposing the rear side of the image parts P1*a* and extension portions P3*c* which are not opposed to the rear side are provided. In the configuration shown in FIG. 5, on the side contacting the clear layer P2 of the extension portions P3*c*, inclined portions P3*d* which are inclined with respect to the rear surface 10*a* of the transparent medium 10 are provided. In so doing, in the inclined portions P3*d*, it is possible to cause large amounts of the light progressing through the clear layer P2 to be reflected through facing the front surface 10*b* side of the transparent medium 10. Further, through the reflection of the light, the contour of the image parts P1*a* is in a state of being more clearly visually recognized (becomes a so-called sharp edge).

Figure 6:
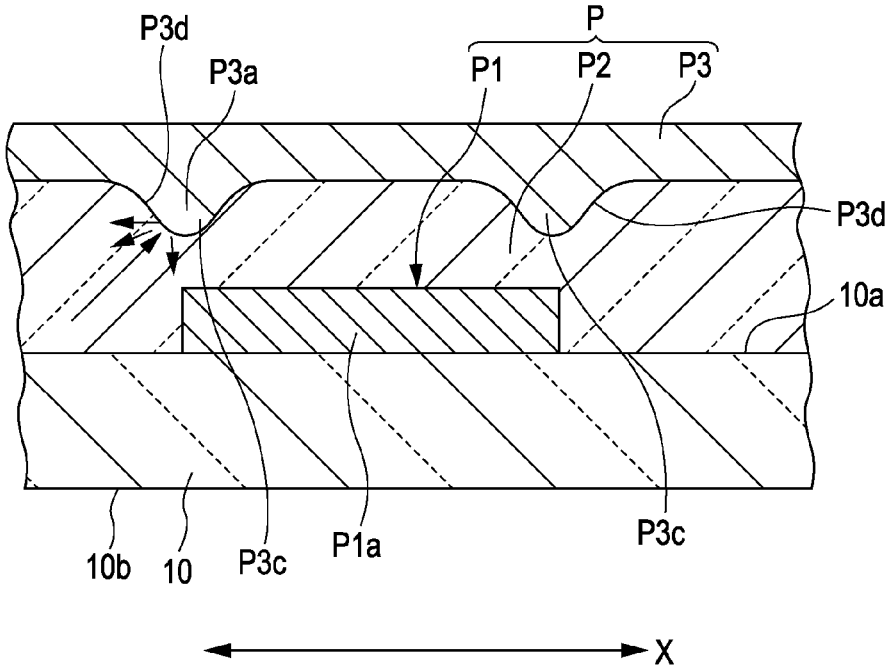
FIG. 6 is a lateral cross-sectional view showing a configuration in which an annular extension portion is provided.

Moreover, as a modification example of FIG. 5, the configuration may be as shown in FIG. 6. In the configuration shown in FIG. 6, the thick portions P3*a* are provided in parts that oppose the contours of the image parts P1*a*. In other words, in the configuration shown in FIG. 6, in the base layer P3, the thick portions P3*a* provided to be thick in parts opposing the contour of the image parts P1*a*, and the thick portions P3*a* are provided in an annular shape; however in the parts of the base layer P3 surrounded with the annular thick portions P3*a*, the thickness of the base layer P3 attains a thickness to the same extent as parts other than the thick portions P3*a*.

Even in such a configuration shown in FIG. 6, similarly to the case shown in FIG. 5, extension portions P3*c* are present in the thick portions P3*a*. Further, in the side contacting the clear layer P2 of the extension portions P3*c*, inclined portions P3*d* inclined with respect to the rear surface 10*a* of the transparent medium 10 are provided. In so doing, in the inclined portions P3*d*, it is possible to cause large amounts of the light progressing through the clear layer P2 to be reflected through facing the front surface 10*b* side of the transparent medium 10. Further, through the reflection of the light, the contour of the image parts P1*a* is in a state of being more clearly visually recognized (becomes a so-called sharp edge).

The above is an outline of the invention.

2. Ink

Next, description will be made relating to ink.

2-1. White Ink

First, particles included in the white ink will be described. In the white ink, metallic oxide particles or organic particles having a hollow structure are contained in a solvent. Examples of such metallic oxide particles include particles of titanium oxide, zinc oxide, alumina, magnesium oxide or the like. In addition, the average particle diameter of the metallic oxide particles is preferably from 30 nm to 600 nm, and more preferably from 200 nm to 400 nm.

In addition, the organic particles having a hollow structure are not particularly limited, and known particles formed from styrene acrylic resin or the like may be used. Here, hollow structure indicates a structure in which a substance differing in at least refractive index is encapsulated, for example, a core-shell structure, in other words, indicates a structure in which a space is surrounded with a shell (husk). In addition, the material of the core (inside surrounded by the husk) of the hollow structure may be a liquid, or may be a gas. The particles having a hollow structure are able to cause light to be scattered by the difference in refractive index occurring between the core and the shell. In so doing, the particles having a hollow structure are able to exhibit a neutral color such as white when attached to a recording medium.

The average particle diameter of the organic particles having a hollow structure (the outer diameter of the shell described above) is preferably from 200 nm to 1000 nm, and more preferably from 400 nm to 800 nm. In addition, the inner diameter of the organic particles having a hollow structure (in other words, the outer diameter of the core described above) is appropriate at approximately 100 nm to 800 nm.

2-2. Clear Ink

Next, the clear ink will be described. The clear ink is a colorless, transparent ink.

The clear ink is used with the object of preventing gloss irregularity through adjusting the gloss, and for example, the clear ink may be used where particles forming the color components are excluded from the components of, in particular, pigment based ink, used in the related art.

More specifically, in order to improve the glossiness and chromagenicity, it is desirable that the composition of the clear ink include polymer fine particles and not include a coloring agent, and examples of the polymer fine particles include a copolymer obtained through polymerizing a sulfonic acid group-containing polymer (sol-type resin), a denatured polypropylene emulsion, ethelynic unsaturated carboxylic acid monomer and other monomers copolymerizable therewith in the presence of an alcoholic hydroxyl group containing a water soluble macromolecular compound or a polymerizable surfactant and an emulsion type resin with a particle series of 70 nm or greater, and the like.

2-3. Other Respective Colors of Ink

Next, other respective colors of ink will be described. In the embodiment of the invention, pigment ink is used as the other respective colors of ink.

3. Transparent Medium

Next, the transparent medium 10 will be described. The transparent medium 10 is one formed in a thin plate-like shape from a raw material having transparency, and for example a PET-G (Polyethylene Terephthalate Glycol) resin, PET (Polyethylene Terephthalate) resin, PVC (Polyvinyl Chloride) or the like may be used. However, as the material, other raw materials having transparency may be used. As such raw materials having transparency, for example, APET (Amorphous Polyethylene Terephthalate), PP (Polypropylene), PS (Polystyrene), acrylic, UV (Ultraviolet) resins and the like are formed as the material.

However, the transparent medium 10 may also be configured as a transparent material other than a material having transparency formed in a thin plate shape (transparent base material). In addition, in a case using a dye ink, the transparent medium 10 may be configured having a transparent ink absorption layer.

4. Printing System 20 and Data Processing

4-1. Configuration Printing System 20

Figure 7:
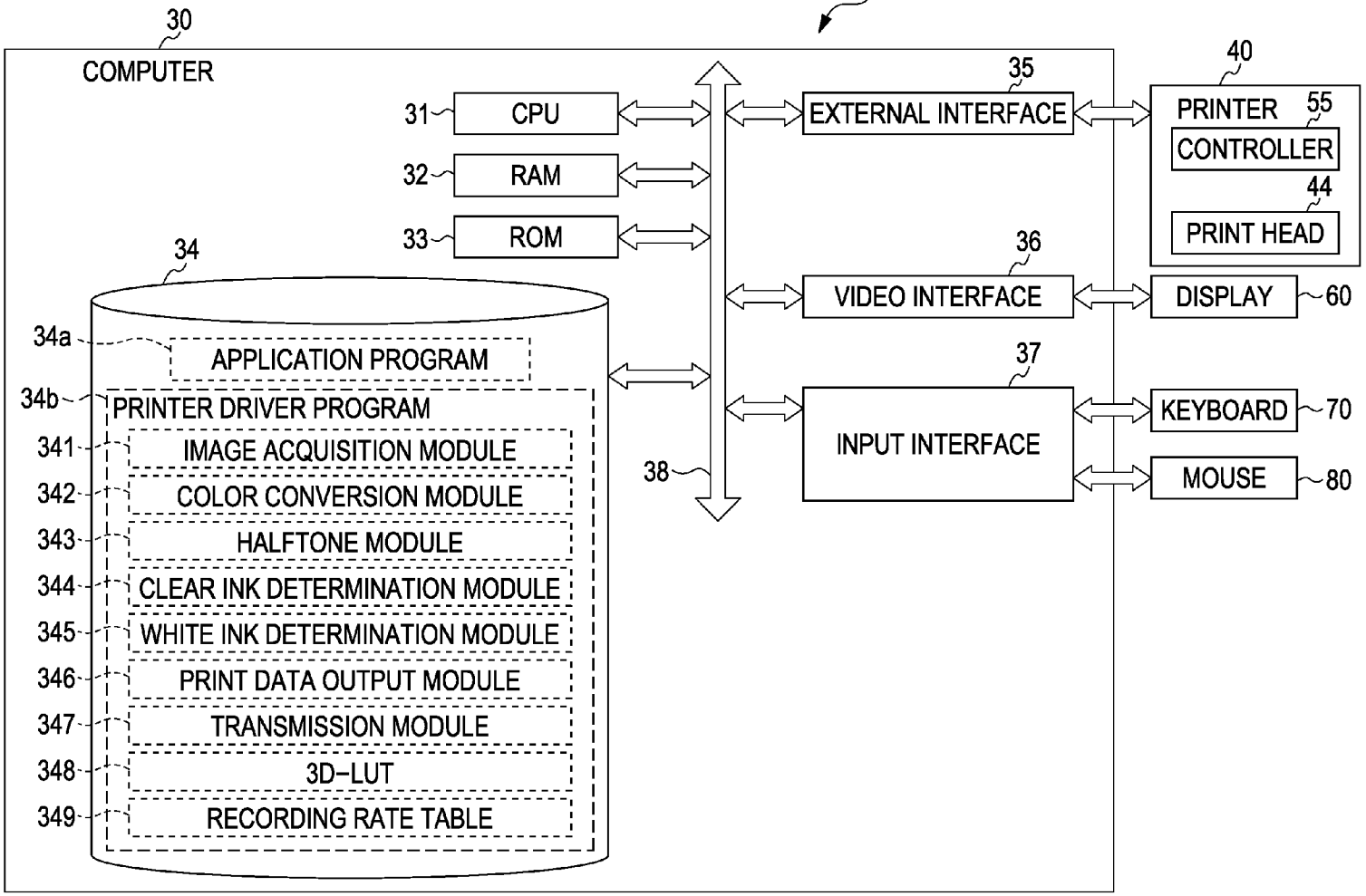
FIG. 7 is a block diagram showing a schematic configuration of a printing system.

FIG. 7 is a block diagram showing a schematic configuration of a printing system according to an embodiment of the invention. The printing system 20 has a computer 30 and a printer 40, and the printer 40 is connected to computer 30. However, the various functions of the computer 30 may be incorporated in the printer 40. In addition, the computer 30, corresponds to the controller of the claims, along with the controller 55 of the printer 40; however, the configuration may be one in which the computer 30 corresponds to the controller of the claims or one in which the controller 55 corresponds to the controller of the claims.

In FIG. 7, the computer 30 is configured from a CPU 31, RAM 32, ROM 33, external storage device 34, external interface 35, video interface 36, input interface 37 and bus 38. The bus 38 realizes data communication between the respective constituent elements 31 to 37 of the computer 30, and communication is controlled using a chip set (not pictured) or the like.

In the external storage device 34, various programs, including an operating system (OS) or data are stored, and an application program 34*a* and a printer driver program 34*b* are present among these. Further, the CPU 31 executes computation according to the programs and data while expanding the programs or data stored in the external storage device 34 such as an HDD or flash memory in the RAM 32.

The external interface 35 is connected to an external device such as a printer or network, and along with receiving printing data and control data from the external device, performed notification of various types of data to the external device. As such an external interface 35, there are ones according to the USB standard, for example. The video interface 36 connects a computer 30 to an external display 60 and is an interface for displaying an image on the display 60. The input interface 37 connects the computer 30 to an input unit such as an external keyboard 70 and mouse 80 or the like, and is an interface for a computer 30 to acquire input signals from the input units.

The application program 34*a* inputs original image data from a scanner device or digital camera or the like outside the figure which passes through an external interface 35. The application program 34*a* causes an image represented by series image data to be displayed on a display 60 via a video driver outside the figure. In addition, the application program 34*a* processes series image data via the printer driver program 34*b*, and outputs the post-processing printing data to the printer 40.

The above-described printer driver program 34*b* has an image acquisition module 341, a color conversion module 342, a halftone module 343, a clear ink determination module 344, a white ink determination module 345, a printing data output module 346, a transmission module 347, a 3D-LUT 348, and a recording rate table 349.

Among these, the image acquisition module 341 performs acquisition of image data) which becomes the printing object from the application program 34*a*. The color conversion module 342 performs processing of converting image data expressed through an RGB (Red, Green, Blue) color system to, for example, image data of the CMYK (Cyan, Magenta, Yellow, Black) color system, with reference to the 3D-LUT 348.

The halftone module 343, through, for example, a dither process, converts the image data in which, for example, 1 pixel is expressed by 256 gradations by the CMYK color system to bitmap data assembled from 3 types of dot, small, medium and large, with reference to the recording rate table 349.

The clear ink determination module 344 determines the ejection amount of clear ink based on image data (bitmap data) on which halftone processing has been performed by the halftone module 343. In other words, the image data after halftone processing is performed corresponds to information relating to a dot being on or off. Therefore, based on the image data after the halftone processing is performed, the clear ink determination module 344 is able to determine if parts are parts in which image parts P1*a* are formed or are parts in which image parts P1*a* are not formed. Therefore, the clear ink determination module 344 determines the ejection amount of the clear ink based on the determination.

More specifically, in the parts in which image parts P1*a* are formed, the ejection amount of the clear ink is determined such that the thickness of the clear layer P2 becomes thin. Conversely, in the parts in which the image parts P1*a* are not formed, the ejection amount of clear ink is determined such that the thickness of the clear layer P2 becomes thick. Moreover, the ejection amount of clear ink in this case corresponds to the thickness of the clear layer P2. In so doing, forming the thickness of the clear layer P2 as shown in FIGS. 1 and 3 to 6 becomes possible.

In addition, the white ink determination module 345 determines the ejection amount of white ink in view of the ejection amount of clear ink. For example, as shown in FIG. 4B, with the thicknesses of the clear layer P2 due to the ejection of clear ink and the base layer P3 due to the ejection of white ink on the rear side of image parts P1*a* as a total L1, when the thickness of the clear layer P2 due to the ejection of clear ink is L1*a*, the white ink determination module 345 determines the ejection amount of white ink such that the base layer P3 has a thickness of (L1-L1*a*).

The printing data output module 346 generates printing data which includes raster data showing the recording state of dots during each main scanning and the data showing sub-scanning feeding amount from bitmap data output from halftone module 343. The transmission module 347 is a module that transmits printing data generated by the printing data output module 346 to the printer 40.

Next, the configuration of the printer 40 will be described. Moreover, in the following explanation, the printer 40 is an ink jet method printer; however, as long as the device is capable of printing by ejecting ink, the ink jet method printer may be a device in which any ejection method is employed. In addition, the invention is applicable to a printer 40 other than an ink jet method printer, such as, for example, a laser method (photosensitive drum corresponding to an example of a printing unit of the claims), sublimation thermal transfer method (thermal head corresponding to an example of a printing unit of the claims), or dot impact method (print head having pins for printing corresponding to an example of a printing unit of the claims).

Figure 8:
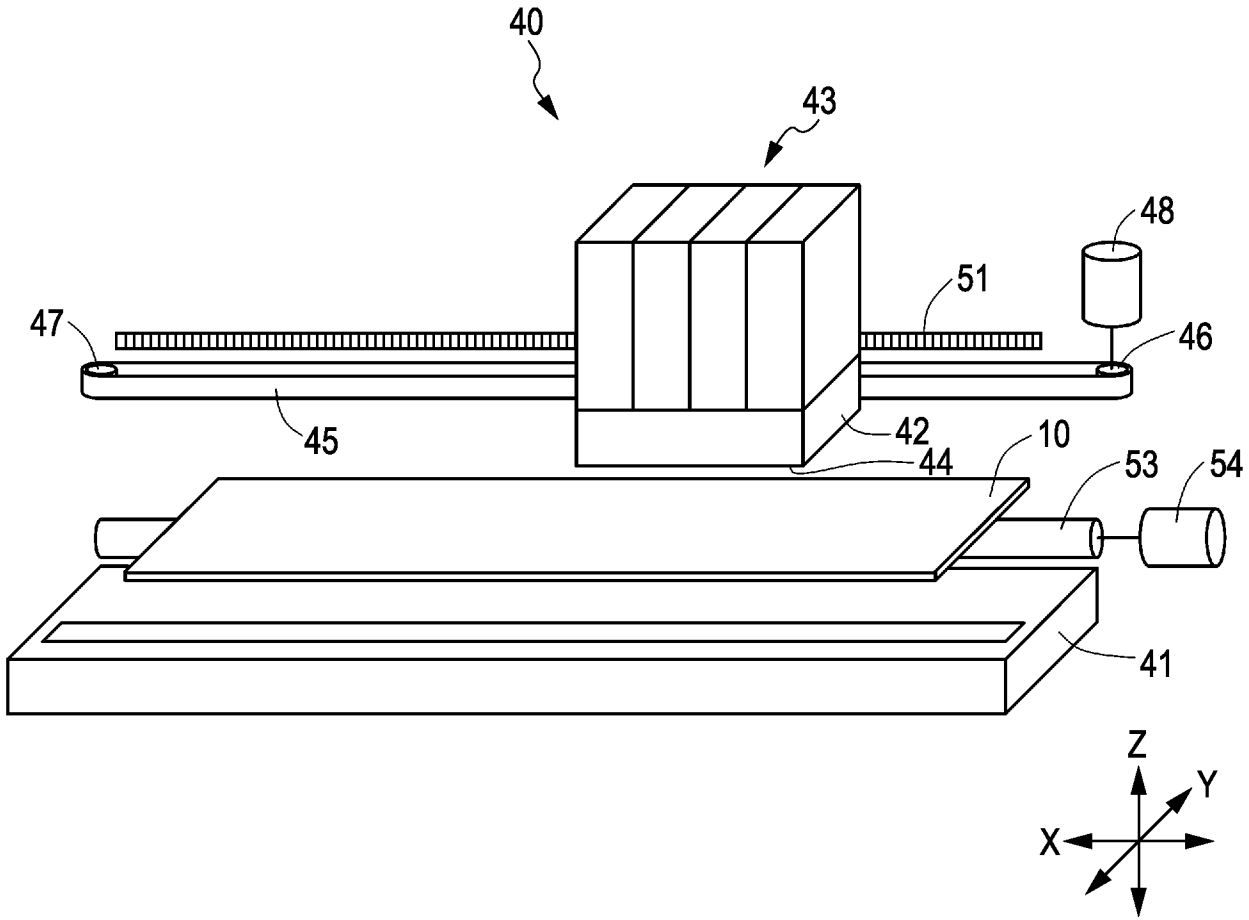
FIG. 8 perspective view showing a schematic configuration of a printer.

As shown in FIG. 8, the printer 40 has a platen 41 and is configured with a carriage 42 freely reciprocally movable with respect to the platen 41. The carriage 42 holds an ink cartridge 43 internally storing cyan (C) ink, magenta (M) ink, yellow (Y) ink, black (K) ink, white ink and clear ink.

On the lower side of the carriage 42, a print head 44 (corresponding to an example of a printing unit of the claims) is provided so as to oppose the transparent medium 10, takes in ink stored in the ink cartridge 43 and is able to eject the ink as minute ink droplets. Moreover, the mounted ink cartridge 43, is not limited to one storing ink as described above, but may have any number of inks, such as five colors of cyan, magenta, yellow, white and clear or 7 or more colors. In addition, the ink filled in the ink cartridge 43 is not limited to dye-based ink, but pigment based ink or the like and other types of ink may installed. In addition, the print head 44 may be able to form dots in a plurality of sizes, by ejecting a plurality of types (small, medium, large) of ink droplets.

A part of a timing belt 45 is fixed to the carriage 42. The timing belt 45 is suspended so as to connect pulleys 46 and 47. A driving axle of the pulley motor 48 is connected to the pulley 46. Accordingly, when the carriage motor 48 is rotated, the carriage 42 reciprocates in the X direction (main scanning direction) shown by the arrow in FIG. 8.

A scale 51 configuring a linear encoder is arranged on the path on which the carriage 42 reciprocates. On the face opposing the scale 51 of the carriage 42, an optical sensor (not pictured) which configures the linear encoder is arranged, and through detecting of the patterns printed on the scale 51 by the optical sensor, the position along the main scanning path of the carriage 42 is specified.

On the upstream side of the platen 41, a paper feed roller 53 having a circular cylindrical shape is provided. Driving power from the paper feed motor (PF motor) 54 as one part of a transport unit is transferred to the paper feed roller 53. Accordingly, when the paper feed motor 54 is rotated, the paper feed roller 53 is rotated, and the transparent medium 10 is transported on the platen 41 toward the paper discharge side in the Y direction (direction indicated by the arrow in the diagram).

In addition, as shown in FIG. 6, a controller 55 is provided in the printer 40. The controller 55 generates a driving signal for driving the print head 44 on the basis of printing data acquired from the printing data output module 346. Further, the print head 44 is controlled and driven on the basis of the driving signal, and the desired printing image P may be formed by ejecting ink to the transparent medium 10.

4-2. Process for Forming Printing Image P

Next, the process for forming the printing image P will be described.

When the image acquisition module 341 acquires sequential image data in the RGB color system from the application program 34*a*, after a predetermined process such as resolution conversion, color conversion to color components printable by the printer 40 (for example, each of the colors cyan (C), magenta (M), yellow (Y), black (K)) is performed in the color conversion module 342 with reference to the 3D-LUT 347.

Thereafter, the halftone module 343 converts, through a dither process, for example, image data in the CMYK color system to bitmap data formed from a combination of 3 types of small, medium and large dots with reference to the recording rate table 349.

In addition, on the basis of image data after halftone processing is performed, the clear ink determination module 344 and the white ink determination module 345 respectively determine the ejection amounts of clear ink and white ink.

Thereafter, the printing data output module 346 generates sorted printing data by matching the formation sequence of the dots by the print head 44 from the bitmap data subjected to halftone processing. Further, the transmission module 347 transmits the sorted printing data towards the printer 40. In addition, the transmission module 347 also transmits information relating to the ejection amount of clear ink and information relating to the ejection amount of white ink towards the printer 40.

Further, the printer 40 which received the printing data on which the data processing is performed, information relating to the ejection of clear ink and information relating to the ejection of white ink forms the printing image P in the state shown in FIGS. 1 and 3 to 6 on the transparent medium 10. In this case, the controller 55 of the printer 40, at first initially forms the design image P1 on the transparent medium 10 through ejection of each color cyan (C), magenta (M), yellow (Y) and black (K) of ink, and thereafter, ejects clear ink. In so doing, after the clear ink is solidified, the clear layer P2 is positioned on the image parts P1*a* and the gap part S between the image parts P1*a*.

Further, after the clear layer P2 is formed, the controller 55 of the printer 40 ejects white ink in a state overlapping the clear layer P2, and thereby the base layer P3 is formed. Moreover, in a case where the base layer P3 shown in FIGS. 1 and 3 to 6 is formed, white ink may be ejected such that, in the base layer P3, the surface (rear surface) of the side away from the transparent medium 10 becomes flat.

In this case, the rear surface of the base layer P3 is flattened.

5. Effects of the Embodiment

According to a printing system 20 with a configuration as above and printing system, by controlling the driving of the print head 44 with the controller 55, the printing image P is formed as follows. In other words, in the printing image P formed on the transparent medium 10, without the base layer P3 arranged directly overlapping the design image P1, the clear layer P2 is in a state overlapping the design image P1. Therefore, the clear ink is in a state approaching the image parts P1*a* of the design image P1 and the gap part S between the image parts P1*a*, and the clear layer P2 formed by the hardening of the clear ink is in a state contacting the transparent medium 10. Therefore, on the base layer P3 side of the transparent medium 10, unevenness in the glossy feeling between the design image P1 and the clear layer P2 is prevented, and it is possible to even the glossy feeling.

In addition, in the embodiment, by controlling the driving of the print head 44 using the controller 55, it is possible to form the printing image P as follows. In other words, as shown in FIGS. 3 to 6, in the parts in which the image parts P1*a* of the design image P1 are present, it is possible for the thick portions P3*a* to be provided with the base layer P3 thicker than the other parts. In this case, the design image P1 is vividly visually recognizable. In other words, in a case in which the thickness of the base layer P3 is thin, in the light reaching the base layer P3 by passing through the transparent medium 10, because the light passing through the base layer P3 increases, in this case the light amount shining from the rear side of the image parts P1*a* decreases. Conversely, in the thick portions P3*a* of the base layer P3, because the light passing through the thick portions P3*a* decreases, in the thick portions P3*a*, the amount of light shining from the rear side of the image parts P1*a* increases. Therefore, in the thick portions P3*a*, compared to a case in which the thickness of the base layer P3 is thin, it is possible for the amount of light shining from the rear side of the image parts P1*a* to be increased, and thereby for the image parts P1*a* of the design image P1 to be more vividly visually recognizable.

In addition, in the embodiment, by controlling the driving of the print head 44 using the controller 55, it is possible to form the printing image P as follows. That is, as shown in FIGS. 3 and 5, in the base layer P3 of the printing image P, it is possible to form the thick portions P3*a* over all portions opposing the image parts P1*a*. In this case, it becomes possible to vividly visually recognize the entirety of the image parts P1*a*.

In addition, in the embodiment, by controlling the driving of the print head 44 using the controller 55, it is possible to form the printing image P as follows. In other words, as shown in FIG. 6, it is possible to form the thick portions P3*a* on the side opposing the contours of the image parts P1*a*, and to form the thick portions P3*a* in an annular shape. In this case, in the design image P1, it is possible to vividly visually recognize the parts opposing the parts opposing the contours of the image parts P1*a*.

In addition, in the embodiment, by controlling the driving of the print head 44 using the controller 55, it is possible to form the printing image P as follows. In other words, as shown in FIGS. 3 and 5 or the like, it is possible to provide the thickness of the clear layer P2 in parts in which the image parts P1*a* are present to be smaller than the thickness after subtracting the thickness of the image parts P1*a* from the thickness of the clear layer P2 in parts in which the image parts P1*a* are not present. In this case, it is possible to make the thickness of the clear layer P2 thin in the parts in which the thick portions P3*a* of the base layer P3 are present.

In addition, in the embodiment, by controlling the driving of the print head 44 using the controller 55, it is possible to form the printing image P as follows. In other words, as shown in FIGS. 5 and 6, in the thick portions P3*a*, extension portions P3*c* which extend from the opposing portions which oppose the image parts P1*a*, and in the extension portions P3*c*, inclined portions P3*d* are provided. In so doing, in the inclined portions P3*d*, it is possible cause large amounts of the light progressing through the clear layer P2 to be reflected through facing the front surface 10*b* side of the transparent medium 10. Further, through the reflection of the light, the contour of the image parts P1*a* is in a state of being more clearly visually recognized (becomes a so-called sharp edge).

6. Modification Examples

Above, embodiments according to an aspect of the invention were explained; however, various modifications of the invention are possible. Below, explanation will be provided.

6-1. Modification Example 1

In the embodiments described above, in the parts of the rear side of the image parts P1*a*, the clear layer P2 is arranged to overlap with the image parts P1*a*, and furthermore the base layer P3 is provided overlapped with the clear layer P2. Here, the image parts P1*a* may be an aggregation of dots formed by attaching of ink droplets, or the image parts P1*a* may be individual dots. In other words, in the rear side of individual dots, it is possible to employ a configuration provided with the clear layer P2 as shown in FIGS. 1 and 3 to 6 and the base layer P3.

6-2. Modification Example 2

In addition, in the embodiments described above, in a case of forming the printing image P on the transparent medium 10 using reverse printing, the printing image P may be visually recognized in a state of front light. However, in a case in which the printing image P is visually recognized, in a state in which, in the brightness of light, a bright side and the oppositely dark side are formed with the transparent medium 10 interposed, the invention may be applied to a case in which the viewer and the bright side are positioned on different sides (a case of backlighting light) with the transparent medium 10 interposed.

Even in this case, the clear layer P2 shown in FIG. 1 is present, and the clear layer P2 is positioned in the gap parts S. Thereby, as in a case in which the base layer P3 is positioned in the gap parts S, it is possible to prevent the glossy feeling becoming uneven.

Moreover, in a case of visually recognizing in backlighting light, the thickness of the base layer P3 may be provided with thin portions thinner than the other portions, without a configuration providing the thick portions P3*a* on the opposing portions P3*b* opposing the image parts P1*a* of the base layer P3. By providing the thin portions on the opposing portions P3*b* opposing the image parts P1*a* in this way, compared to a case in which the thin portions are not provided in the base layer P3, it is possible to increase the amount of light shining from the rear side of the image parts P1*a*, and thereby the image parts P1*a* of the design image P1 may be more vividly recognized.

6-3. Modification Example 3

In addition, in the embodiments described above, in the concept of the printer 40, a liquid ejecting device may be included in which other liquids other than ink (includes the liquid itself, a liquid body into which particles of a functional material are dispersed or mixed, or a material having fluidity such as a gel) may be ejected. As such a device, there are a liquid ejecting device that ejects a liquid including an electrode material or coloring material or the like in a dispersed or dissolved form used in the manufacturing or the like of a liquid crystal display, EL (electroluminescence) display and a surface emitting display, a fluid ejecting device that ejects a bio-organic substance used in the manufacturing of biochips, a fluid ejecting device used as a precision pipette that ejects a liquid that is a sample, and the like.

6-4. Modification Example 4

Furthermore, as devices included in the concept of the printer 40 of the invention, there are a fluid ejecting device that ejects a pinpoint of lubricant to a precision mechanism such as a timepiece or camera, a fluid ejecting device that ejects a transparent resin liquid, such as an ultraviolet curable resin, for forming a fine semi-spherical lens (optical lens) or the like used in an optical communication element onto a substrate, a fluid ejecting device that ejects an etching liquid such an acid or alkali for etching a substrate or the like, a fluid body ejecting device that ejects a fluid body such as a gel (for example, a physical gel), and the like.

What is claimed is:

1. A printer that forms a printing image on a transparent medium, comprising:

a printing unit that performs printing by causing at least one of respective colors of ink, clear ink and white ink to be ejected onto the transparent medium;

a controller that controls the printing unit; wherein, the controller forms the printing image configured from a design image, a clear layer and a base layer by performing control so as to form the design image on the transparent medium by causing respective colors of ink to be ejected from the printing unit, and thereafter controlling so as to form a clear layer by causing clear ink to be ejected from the printing unit in a state overlapping the design image, and further thereafter performing control so as to form a base layer by causing white ink to be ejected from the printing unit in a state overlapping the clear layer.

2. The printer according to claim 1, wherein along with the design image being configured by a plurality of image parts formed through attaching respective colors of ink to the transparent medium, the controller controls the printing unit such that thick portions are formed, which have the thicker base layer along the direction away from the transparent medium than the other parts in parts where image parts are present.

3. The printer according to claim 2, wherein the controller controls the printing unit such that thick portions are formed in all the portions opposing the image parts.

4. The printer according to claim 2, wherein the controller controls the printing unit such that the thick portions are formed in an annular shape on the side opposing the contour of the image parts.

5. The printer according to claim 2, wherein the controller controls the printing unit so as to provide the thickness of the clear layer along a direction away from the transparent medium in parts in which the image parts are present to be smaller than the thickness after subtracting the thickness of the image parts from the thickness of the clear layer in parts in which the image parts are not present.

6. The printer according to claim 2, wherein in the thick portions, along with the opposing parts opposing the image parts, an extension portion is provided in which the thickness becomes thinner as it separates from the opposing portion along with extending from the opposing portion, an inclined portion is provided in the side contacting the clear layer of the extension portion and the inclined portion is inclined with respect to a contact face of the transparent medium that contacts the clear layer.

* * * * *